United States Patent [19]

Chandler

[11] Patent Number: 4,502,172

[45] Date of Patent: Mar. 5, 1985

[54] SWIMMING POOL CLEANER

[76] Inventor: Michael J. Chandler, The Coach House, Turners Hill Rd., Worth, Crawley, E. Sussex, England

[21] Appl. No.: 422,290

[22] Filed: Sep. 23, 1982

[30] Foreign Application Priority Data

Sep. 28, 1981 [GB] United Kingdom ..... 8129187
Jun. 18, 1982 [GB] United Kingdom ..... 8217666

[51] Int. Cl.[3] ..... E04H 3/20
[52] U.S. Cl. ..... 15/1.7; 15/398
[58] Field of Search ..... 15/1.7, 398, 415 R

[56] References Cited

U.S. PATENT DOCUMENTS 3,008,160 11/1961 West ..... 15/1.7
3,626,535 12/1971 Bond ..... 15/1.7

FOREIGN PATENT DOCUMENTS 401359 7/1967 Australia ..... 15/1.7
2461302 7/1975 Fed. Rep. of Germany ..... 15/1.7

*Primary Examiner*—Edward L. Roberts

[57] ABSTRACT

A vacuum cleaner head for use in swimming pools comprises a flexible sheet of material having a suction aperture therethrough, means for attaching to the sheet a device for applying suction through said aperture and means providing spacing of said flexible sheet from the interior surfaces of the pool when in use. The head, when caused to move over the interior surface of the pool, may flex at least around axes both transverse and parallel to the direction of movement. Such a cleaner head provides significant advantages in cleaning contoured pool walls or floors since it will flex in practically any direction and is of simple construction. It is preferred to make the head out of high specific gravity rubber or synthetic rubber material.

9 Claims, 3 Drawing Figures

SWIMMING POOL CLEANER

This application relates to a swimming pool cleaner. More particularly it relates to a vacuum cleaner head for use in swimming pools.

A variety of vacuum cleaner heads for use with suitable suction apparatus in swimming pools are shown in the prior art. Such heads are usually adapted for attachment to a suction hose and usually have, or can be fitted with, an elongate handle so that they may be moved over the floor or walls of a swimming pool to remove dirt, leaves or other undesired matter through suction. It is desirable to cut down the amount of turbulence caused by movement of the head so that as much dirt as possible lying on the floor or wall of the pool can be sucked away.

British Patent Specification No. 1,444,522 describes a vacuum cleaner head in which the head is articulated. One section of a part of the head is hingedly connected to another section of that part along an axis transverse to a direction in which the head is designed to move and such an arrangement permits the head to be moved into right angles between the pool walls and floor causing minimum turbulence and effecting maximum suction. The sections referred to are generally made of a rigid material such as plastic and are pivoted relative to each other on stub axles.

Other vacuum cleaner heads have been described in, for example, U.S. Pat. Nos. 3,360,816; 3,273,188 and 3,085,267. All these devices, together with the device described in British Patent Specification No. 1,444,522 suffer from the same defect in being unable to flex around more than one axis. The device of British Patent Specification No. 1,444,522 will articulate along an axis transverse to the direction of intended movement of the head but will not twist laterally and certainly will not flex along an axis parallel to the direction of intended movement. Each of the devices of the three U.S. Patents will either flex or articulate along an axis parallel to the general intended direction of movement but is rigid with regard to flexing around any other axis. All these devices are substantially torson-resistant.

It will of course be realized that the inability of any of these devices to flex around a particular axis will frequently lead to imperfect operation, particularly in modern, contoured pools, since a gap may be created between the device and the surface which the device cannot follow because of the irregular contour. In addition to adversely affecting the ideally uniform suction, any brushes with which the device may be fitted would clean irregularly.

I have now devised a vacuum cleaner head for use in swimming pools that will flex in at least two generally perpendicular axial planes. My device is in fact capable of flexing is almost any direction so as to adopt almost any configuration which will fit the contours of a pool floor or walls and is sufficiently flexible to allow a much closer configurational agreement with, for example, curved pool walls or floors. With previous devices it has generally been necessary always to approach an edge or curve in a direction perpendicular to that edge or general line of the curve because the devices will only flex or articulate in one direction. With my new device, almost any contour or edge can be approached from any direction. In addition my new device provides economic savings over previously described devices and is much more suitable for domestic pool use than the more expensive devices previously known.

Accordingly, I provide a vacuum cleaner head suitable for cleaning the interior surfaces of a pool such as a swimming pool using suction, which comprises a flexible sheet of rubber, plastics or other suitable material having a suction aperture therethrough, means for attaching to the sheet a device for applying suction through said aperture and means providing spacing of said flexible material from the interior surfaces of the pool when in use, wherein in use the head when caused to move over the interior surface of the pool may flex at least around axes both transverse and parallel to the direction of movement.

There will be associated with the head means enabling the movement and control of the head whilst in use. Such means may be an attachment for a handle, or the device which applies suction may be sufficiently rigid along a portion of its length so as to fulfil a dual role as suction hose and handle.

The vacuum cleaner head will preferably be provided with a brush across the width of the under surface thereof. The brush will also have a flexible backing so as not to substantially impair the flexibility of the head. Unlike previous devices, the brush may cross the entire width of the head in view of the lack of any encumbrance which would prevent this, and such an embodiment permits a full width brushing action enabling the edge of the device to brush and clean right up to and along a right-angled edge.

Means are provided for spacing the flexible material from the interior surface of the pool when in use. This is important to cut down on turbulence and ensure a more direct, positive suction. Such means generally will take the form of wheels which may be mounted on brackets or other support means generally on the upper surface of the vacuum cleaner head. Such brackets may provide localised stiffening of the flexible material but the general ability of the vacuum cleaner head to flex in almost any direction will not be substantially impaired.

The flexibility of the vacuum cleaner head will enable the cleaning of a right angled corner, for example between the pool floor and sides by allowing the leading edge of the head to flex upwards and back on itself towards the trailing edge and allow suction to be applied to the corner.

I have found that advantages also exist if the cleaner head is made from a flexible high specific gravity rubber or a synthetic rubber type material, e.g. an EPDM-based compound. Such material may be prepared to have a specific gravity in the region of for example in excess of 1.5, such as from 1.5 to 2.5. Using such a material, I have found it possible to avoid the need for any further significant weighting in order to assist in keeping the cleaner below the surface of a pool, although, if desired, weights may be provided in the leading wheels. This general avoidance of substantial weights provides a useful economic advantage in addition to providing a vacuum cleaner head in which the weight is more evenly distributed. In particular, a greater proportion of the weight is concentrated over the brush, thus leading to more efficient cleaning.

My invention will now be described by way of example with reference to the accompanying drawings, in which.

Figure 1:
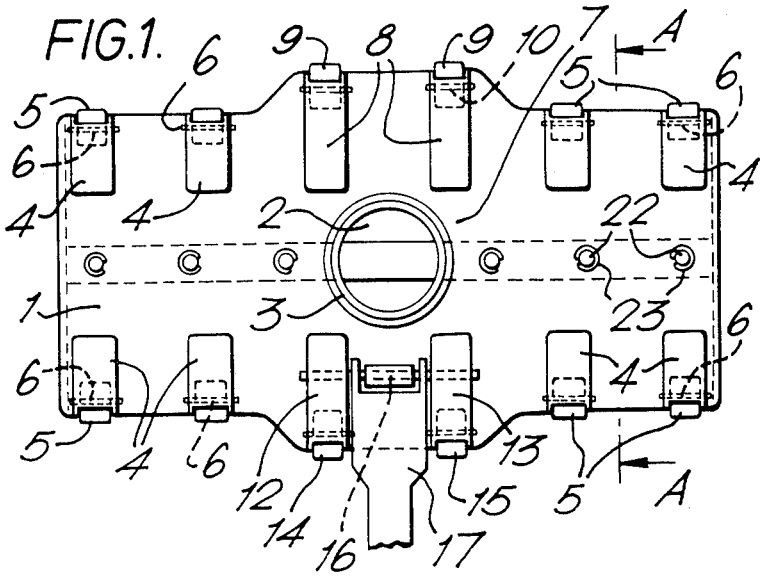
FIG. 1 is a plan view of the upper surface of a vacuum cleaner head of the invention.
Figure 2:
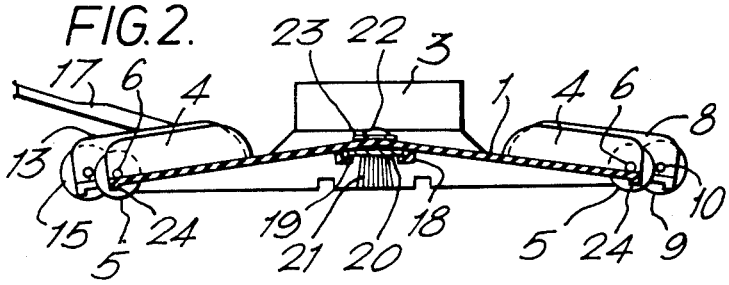
FIG. 2 is a cross-section of a vacuum cleaner head of the invention along a line A—A in FIG. 1.

In FIGS. 1 and 2, a vacuum cleaner head comprises a sheet 1, approximately rectangular in form and having dimensions of, for example, 450×200×4 mm. The sheet is flexible in all directions and is made, for example, of a high specific gravity EPDM rubber material. At the centre of the sheet an aperture 2 is shown through which suction may be applied, said aperture having a flexible raised rim 3 on the upper surface adapted for attachment, for example by a screw or bayonet fitting, to a means for applying suction (not shown). Rubber supports 4 are provided on the upper surface of the sheet for rotatably mounting wheels 5 on shafts 6 which provide spacing of the sheet 1 from a surface which in use the vacuum cleaner head is intended to clean. The wheels and mountings are of a simple two-piece variety moulded e.g. in polypropylene and each comprising a wheel 5 rotating around a shaft 6, which shaft may simply be pressed into and retained by appropriate housing apertures in the rubber support 4.

The sheet 1 has a central area of greater width 7, for example of 270 mm, which carries supports 8 bearing slightly larger wheels 9 on shafts 10.

By having the ends of each shaft eccentrically mounted and provided with a screwdriver slot the shaft may be rotated within its housing thus varying the wheel position relative to the under surface of the head. This is of great value in assisting control of the suction and in varying the position of the head relative to the pool floor or wall.

Two additional supports 12 and 13 carry rotatably mounted further spacing wheels 14 and 15 and said additional supports further carry together a pin 16 which acts as a pivot for a connecting bracket 17 adapted to receive and secure an operating handle (not shown), for example by a butterfly nut and cooperating bolt. The point of connection of this connecting bracket is off-centre and enables the flap-like area of greater width to which the bracket and handle are attached to be easily lifted to assist folding into and out of a corner.

On the undersurface of the sheet 1 is mounted a flexible track 18 having flanges 19 adapted to receive the flexible backing 20 of a brush 21. The track may extend the whole width of the head, being clipped to it at suitable intervals, or may be provided by a number of shorter individual elements of similar cross-section each of which may be clipped to the head via a stud portion 22 and retaining C-clip 23.

The undersurface of the sheet 1 has a slightly raised rim 24 along its leading and trailing edges, interrupted only by the wheels. This helps narrow down the gap between the sheet and the pool floor or wall being cleaned even further thus locally accelerating the flow of water into the space under the head when in use. This is useful in assisting the dislodging of larger particles or dirt on the pool surface.

Figure 3:
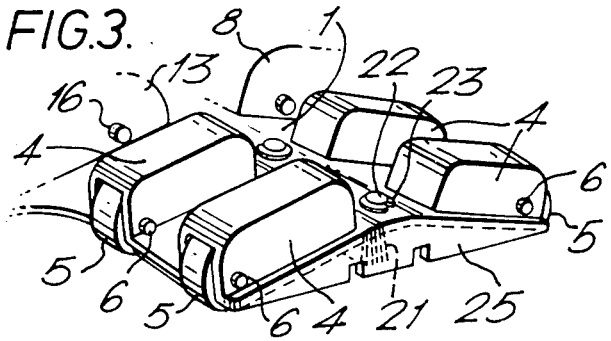
FIG. 3 shows a perspective view of one end of the vacuum cleaner head of the invention.

At each end of the device a shallow inverted "V" shape is adopted by the head when it is in use in view of the depth of the brush and the weight and flexibility of the material of which the head is made. The rims at each end can be extended if desired so as to fill in the greater portions of the gap thus created. This is shown by the skirt-like extension 25 in FIG. 3.

I claim:

1. A vacuum cleaner head suitable for use in the cleaning of the interior surfaces of a pool comprising a sheet of flexible material, said sheet having an upper side which is intended to face away from the pool surface to be cleaned and an opposite lower side, said sheet further having front and trailing edges and a pair of substantially parallel side edges, a centrally located aperture in said sheet, means for coupling a source of suction pressure to the head, said coupling means circumscribing said aperture and being located on the said upper side of said sheet, means for spacing the front and trailing edges of said sheet from the interior surfaces of the pool when in use, said spacing means including a plurality of support means on said upper side of said sheet adjacent the periphery of said front and trailing edges, said spacing means each further including a wheel mounted from each of said support means and extending partly below the lower side of said sheet, means for attaching a handle to the upper side of said sheet whereby motion may be imparted to the head to cause the head to move over the interior surface of a pool being cleaned, the material characteristics of said sheet and the positioning of said support means being selected whereby said sheet may simultaneously flex relative to a first axis transverse to said side edges and a second axis transverse to said first axis, and brush means supported from said lower side of said sheet and extending transversely with respect to said side edges, said brush means extending below said sheet a distance which is greater than the extension of said wheels below said front and trailing edges whereby the bottom of said sheet in the vacinity of said brush means is spaced a greater distance from the pool surface being cleaned than are said front and trailing edges.

2. The apparatus of claim 1 wherein said front and trailing edges of said sheet are provided with cut-outs in the vacinity of said support means and wherein said wheels are in part positioned in said cut-outs.

3. The apparatus of claim 1 wherein said sheet is provided with downwardly extending flanges at said side edges.

4. The apparatus of claim 1 wherein said brush means comprises:

a flexible brush support, said brush support being affixed to the lower side of said sheet along a region which is substantially evenly spaced between said front and trailing edges, said brush support defining a pair of facing grooves which extend between said flexible sheet side edges; and a brush mounted in said brush support, said brush including a flexible backing.

5. The apparatus of claim 4 wherein said sheet is provided with downwardly extending flanges at said side edges.

6. The apparatus of claim 2 wherein said front and back edges of said sheet are provided with cut-outs in the vacinity of said support means and wherein said wheels are in part positioned in said cut-outs.

7. The apparatus of claim 6 wherein said sheet is comprised of a material having a specific gravity in excess of 1.5.

8. The apparatus of claim 7 wherein said sheet is further provided with downwardly extending flanges along said front and trailing edges.

9. The apparatus of claim 1 wherein said sheet is comprised of a material having a specific gravity in excess of 1.5.

* * * * *